US005666258A

United States Patent [19]

Gevatter et al.

[11] Patent Number: 5,666,258

[45] Date of Patent: Sep. 9, 1997

[54] MICROMECHANICAL RELAY HAVING A HYBRID DRIVE

[75] Inventors: Hans-Jürgen Gevatter; Lothar Kiesewetter; Joachim Schimkat; Helmut Schlaak, all of Berlin, Germany

[73] Assignee: Siemens Aktiengesellschaft, Munich, Germany

[21] Appl. No.: 505,312

[22] PCT Filed: Feb. 14, 1994

[86] PCT No.: PCT/DE94/00152

§ 371 Date: Aug. 17, 1995

§ 102(e) Date: Aug. 17, 1995

[87] PCT Pub. No.: WO94/19819

PCT Pub. Date: Aug. 1, 1994

[30] Foreign Application Priority Data

Feb. 18, 1993 [DE] Germany ..... 43 05 033.6

[51] Int. Cl.[6] ..... H01H 57/00; H01H 59/00

[52] U.S. Cl. ..... 361/207; 361/233

[58] Field of Search ..... 307/400; 310/317; 200/181; 361/207, 211, 233, 234

[56] References Cited

U.S. PATENT DOCUMENTS 4,480,162 10/1984 Greenwood .
4,819,126 4/1989 Kornrumpf et al. ..... 361/207

FOREIGN PATENT DOCUMENTS 32 07 920 2/1984 Germany .
42 05 029 2/1993 Germany .
42 05 340 8/1993 Germany .
738 009 4/1977 U.S.S.R. .

OTHER PUBLICATIONS

Sakata, "An Electrostatic Microactuator for Electro–Mechanical Relay", *IEEE Micro Electro Mechanical Systems*, Feb. 1989, pp. 149–151.

*Primary Examiner*—Fritz Fleming
*Attorney, Agent, or Firm*—Hill, Steadman & Simpson

[57] ABSTRACT

A micromechanical relay is provided having a cantilevered armature (53) which is etched out from an armature substrate (52). The armature is in the form of a tongue, is elastically connected to the armature substrate, and forms an electrostatic drive with a base electrode (58) of a base substrate (51) located underneath. In addition, a piezo-layer (60) is provided on the armature (53). The piezo-layer (60) acts as a bending transducer and forms a supplemental actuator for a quick response time. When a voltage is applied to the electrodes of the armature (53), base substrate (51) and piezo-layer (60), the armature is attracted toward the base substrate and then rests over a large area on the base, closing at least one contact (55, 56). The different characteristics of the electrostatic actuator, on the one hand, and of the piezo-drive, on the other hand, are complementarily combined to provide a strong attraction force at the start of the armature movement, and a strong contact force is produced after the armature has been attracted.

7 Claims, 2 Drawing Sheets

MICROMECHANICAL RELAY HAVING A HYBRID DRIVE

BACKGROUND OF THE INVENTION

The present invention generally relates to a micromechanical relay. More specifically, the present invention relates to such a relay having a hybrid drive including both piezo and electrostatic drive elements.

A micromechanical relay having an electrostatic drive is known, for example, from an article by Minoru Sakata: "An Electrostatic Microactuator for Electro-Mechanical Relay", IEEE Micro Electro Mechanical Systems, February 1989, pages 149 to 151. There, an armature which is etched free from a silicon substrate is mounted via two torsion webs on a center line such that each of its two vanes is opposite a base electrode located underneath. Voltage is in each case applied between the armature electrode and one of the two base electrodes for electrostatic excitation of this relay, so that the armature selectively carries out a pivoting movement to one side or the other. A specific wedge-shaped air gap remains between the electrodes even after the pivoting movement, as a result of the separation distance of the torsion mounting, so that the electrostatic attraction force remains relatively low. This also results in a relatively low contact force.

German patent document DE 32 07 920 C2 and related U.S. Pat. No. 4,480,162 relate to an electrostatic relay. There, an armature is etched out of a frame plate made of crystalline semiconductor material. The armature, with the frame plate, is placed onto an insulating substrate which is also fitted with the mating electrode. However, there is a relatively large separation distance between the armature and the mating electrode, which also remains when the armature is attracted. In order to produce the desired contact forces with this separation distance between the armature and the mating electrode, relatively large voltages are required in the case of this known relay.

A relay is described in German patent document DE-C-42 05 029. There, the armature electrode of the tongue-shaped armature forms a wedge-shaped air gap with a base electrode which is arranged inclined with respect to it, on which air gap the armature rolls during the attraction movement until it rests over a large area on the base electrode in the attracted state. This results in a large electrostatic attraction force which ensures an adequate contact force even in the case of micromechanical dimensions.

In addition, it has already been proposed in the document SU-A-738 009 for an electrostatic drive to be combined with a piezoelectric drive in order to achieve a reduced response voltage. However, a diaphragm is proposed there which is clamped in on opposite edges, is composed of a polymeric polyvinylidene fluoride which is intended to act as an armature and is provided with electrodes in order to produce an electrostatic drive. Since, because it is clamped in on two sides, this piezo-film can become effective only by central bending out as a result of a length change produced piezoelectrically, it is not possible to achieve any large electrode surfaces lying on one another in the final state, so that the electrostatic attraction force for producing the contact force must be relatively low.

In general, an electrostatic drive for relays has the disadvantage that the attraction force is relatively low at the start of the armature movement when there is a large separation distance between the electrode, so that the relay responds only with a delay or requires high response voltages. Therefore, an object of the present invention is therefore to develop a micromechanical relay of the type mentioned initially such that the response characteristic is improved, such that the advantages of the electrostatic drive—a relatively high contact force when the armature is attracted—are retained, but the forces at the start of the response are at the same time increased.

SUMMARY OF THE INVENTION

To this end, in an embodiment, the present invention provides a micromechanical relay having a base substrate fitted with a flat base electrode and at least one stationary mating contact piece. Also, an armature substrate is arranged on the base substrate, the armature substrate being made of a material which is selectively etchable. In the armature substrate, at least one armature is etched in the form of a tongue, each armature being generally cut free from the armature substrate but having one end remaining attached to the rest of the substrate. Each armature is fitted with an armature electrode and an armature contact piece disposed opposite the base electrode. Furthermore, the armature includes an elastically flexible region between the point of attachment to the armature and the armature contact piece, such that the armature is attracted toward the base substrate when an electrical voltage is applied between the armature electrode and the base electrode. Electrical supply leads are provided on the base substrate, to the armature substrate, to the electrodes, to the contact pieces and to the piezo-layer.

The objects are achieved according to the invention in that the armature is provided in at least one part of the above-mentioned flexible region with a piezo-layer which acts as a bending transducer and whose bending force on excitation assists the electrostatic attraction force between the base electrode and the armature electrode.

Thus, in the case of the relay according to the invention, the armature is provided with a piezo-drive in addition to the electrostatic drive. The properties of two drive systems are usefully combined in the case of this hybrid drive formed in this way, in such a manner that the advantages of the one drive outweigh the disadvantages of the respectively other drive. The piezo-drive can displace the armature through a large path or over a large switching travel, but produces only a small force when the armature deflection is high, such as in the closed or operating position. On the other hand, although the electrostatic drive produces a large contact force in the closed or operating position, such as when the armature is attracted, the electrostatic attraction force is small at the start of the armature movement, when the electrode separation distances are large.

In the relay according to the invention, the armature, which is in the form of a tongue which is fitted with the armature electrode and the piezo-layer, is connected on one side to the armature substrate such that it can pivot. In the case of this relay, a relatively large electrostatic attraction force is produced from the start by means of an air gap, which is wedge-shaped to a greater or lesser extent, between the armature and the base, which attraction force, however, is further improved by superimposition of the piezo-electric force. The base electrode is preferably arranged on an obliquely etched section of the base substrate in this case, in such a manner that the armature electrode forms the said wedge-shaped air gap with it in the quiescent state and rests on it, approximately parallel, in the energized state. Since no air gap whatsoever remains in this case, apart from the necessary thin insulating layers, after attraction of the armature between the electrodes, relatively large contact forces can be obtained.

In an embodiment, the base electrode is arranged on an obliquely etched section of the base substrate such that the armature electrode forms a wedge-shaped air gap with the base electrode in its normal or quiescent state. In its energized state, the armature electrode rests on the base electrode, approximately parallel thereto.

Also, in an embodiment, the armature may be formed from a surface layer of an armature substrate which is composed of semiconductor material. The armature is exposed on three sides and is undercut by etching. The base substrate is connected to the surface of the armature substrate.

Additional features and advantages of the present invention are described in, and will be apparent from, the detailed description of the presently preferred embodiments and from the drawings.

BRIEF DESCRIPTION OF THE DRAWINGS

The invention is explained in more detail in the following text using an exemplary embodiment and with reference to the drawing, in which.

DETAILED DESCRIPTION OF THE PRESENTLY PREFERRED EMBODIMENTS

Figure 1:
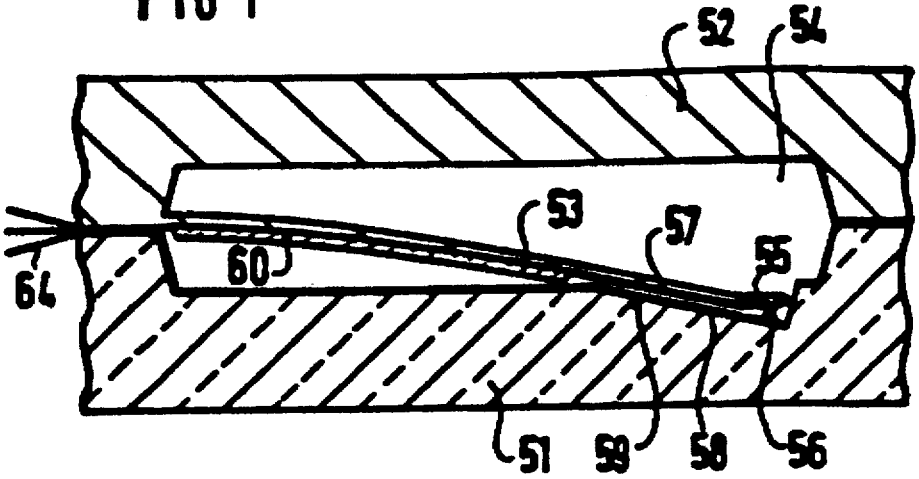
FIG. 1 shows a hybrid relay having an armature which is in the form of a tongue and is mounted on one side.

FIG. 1 schematically illustrates a micromechanical hybrid relay, the actual size relationships being ignored in favour of clarity. In this case, a base substrate 51 is provided which may be composed, for example, of silicon, but preferably alternatively of borosilicate glass having high chemical resistance and low coefficient of expansion, such as PYREX glass. An armature substrate 52, which may preferably be composed of silicon, is arranged and fastened on this base substrate 51. An armature 53, which is in the form of a tongue, is formed in this armature substrate 52 as an etched-free surface region. The base substrate 51 and the armature substrate 52 are connected to etched-free regions at their edges such that the armature 53 is located in a closed contact space 54.

At its free end, the armature has an armature contact piece 55 which interacts with a stationary mating contact element 56 of the base substrate. Furthermore, an armature electrode 57, in the form of a metal layer, is arranged on the armature, on its surface region facing the base, which armature electrode 57 for its part is opposite a base electrode 58 of the base substrate. These two electrodes 57 and 58 form an electrostatic drive for the relay. The base electrode 58 is in this case arranged on an inclined section 59 of the base substrate such that the armature electrode 57 always lies parallel on the base electrode 58 when the armature is in the attracted state—as illustrated in FIG. 1.

In addition, the armature 53 has a piezoelectric drive in the form of a piezo-layer 60 which operates as a bending transducer and, above all, provides the necessary attraction force for the armature at the start of the armature movement.

Although illustrated only by way of indication by 64 in FIG. 1, electrical supply leads must, of course, be provided to the contact pieces 55 and 56 as well as to the electrodes 57 and 59 and to the electrodes, which are not illustrated in any more detail, of the piezoelectric transducer 60. These supply leads are applied using conventional film technology, it being possible for individual conductor tracks to lie side by side in a plane, of course. Thus, the supply lead to the movable contact piece 55 can lie with the electrode 57 in one plane and can be separated from it, within this plane, by corresponding intermediate spaces. The tongue end of the armature 53 can also be split by longitudinal slots into, for example, three ends which can move with respect to one another. In this way, the tongue end which is provided with the contact piece 55 could bend elastically in order to increase the contact force, while the side tongue ends, on which the electrode layer is located, lie flat on the base electrode 58. It should be mentioned, purely for the sake of completeness, that the insulation between layers of different potential is ensured by means of suitable insulation layers, although these layers are not illustrated per se.

Figure 2:
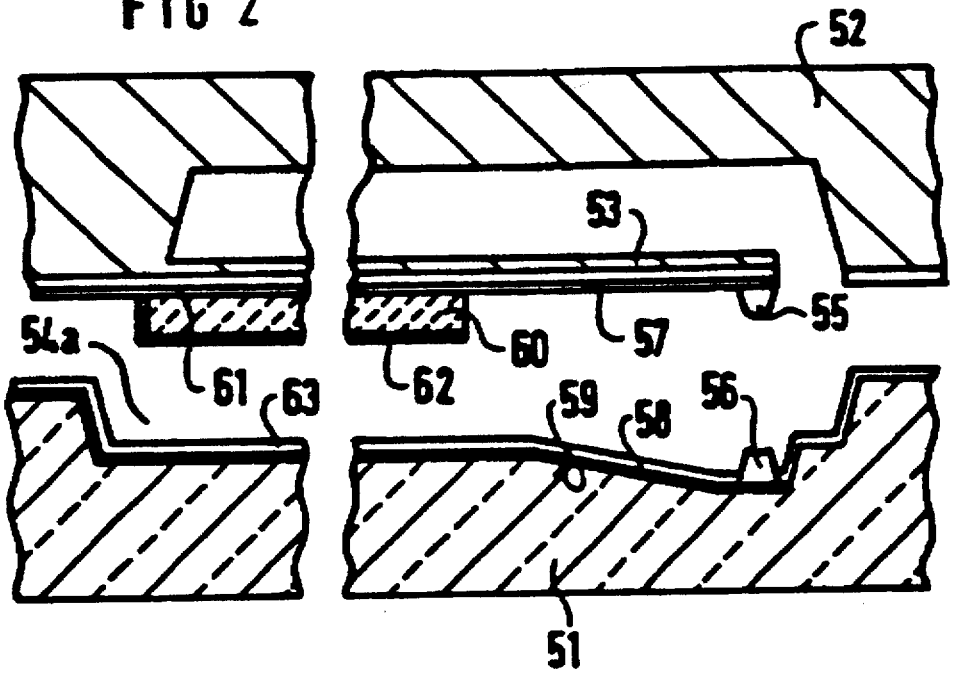
FIG. 2 shows a sectional view, which is illustrated enlarged and is not to scale, of the layers in the armature and base substrate of .a relay according to FIG. 1.

FIG. 2 shows the two parts which form the relay, before assembly, once again in a somewhat enlarged illustration in order to emphasize the layers somewhat more clearly. However, it should be mentioned that, in this schematic illustration, the geometric relationships are not to scale and do not correspond to the actual lengths and thicknesses of the individual layers. The tongue which forms the armature 53 is exposed by selective etching from the armature substrate 52 during production. This tongue is thus composed of silicon in the same way as the substrate itself, but is made resistant to etching by doping. An $SiO_2$ layer is produced on it as an insulation layer and a metal layer is in turn applied onto it, which metal layer is composed, for example, of aluminum and on the one hand forms the armature electrode 57 while on the other hand also forming the supply lead for the contact piece 55 and the inner electrode 61 for the piezoelectric layer 60 which is to be applied after this. If the metallic surfaces or leads need to be insulated from one another, this is done by appropriate longitudinal interruptions. After the piezoelectric layer 60, its outer electrode 62 is applied likewise, as a metal layer. The contact piece 55 is applied electrochemically at the free end of the tongue or of the armature 53. In addition, the front end of the tongue can be divided by two slots into a switching spring and two electrostatic armature elements located at the sides.

The base is likewise produced from a base substrate 51, by etching from silicon or from low-expansion glass, such as PYREX glass. In a first etching step, a trench **54*a* is produced anisotropically or isotropically, its base being parallel to the wafer surface. In a second etching step, a wedge-shaped recess is then etched in the trench base, using a technique which is known per se, in order to produce the incline 59 which is inclined at a slight angle with respect to the surface of the substrate. The inclination is illustrated in exaggerated form in the drawing. In a practical example, the angle is in the order of magnitude of 3°. A metal layer is then produced on the etched surface shape in order to form the base electrode 58 and the supply leads which are required. The contact piece 56 is produced electrochemically. In addition, an insulation layer 63, composed of $SiO_2$ for example, is applied in a conventional manner. In one possible modification, the piezoelectric layer 60 can also be extended over the entire length of the tongue. In this case, it would act as an insulation layer between the electrodes 57 and 58 so that the additional insulation layer 63** would become unnecessary.

The two substrates 51 and 52 are joined together in a known manner, for example by anodic bonding. In this case, the corresponding supply leads to the metal layers are also provided, although this does not need to be illustrated in more detail in the figure.

Figure 3:
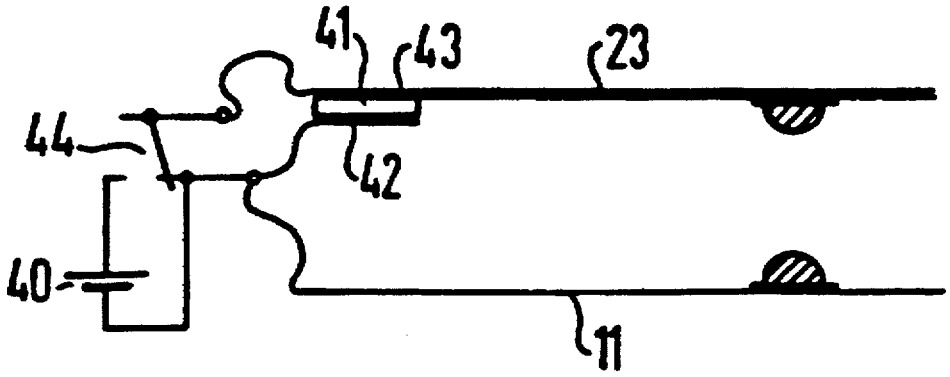
FIG. 3 shows a schematic drive circuit for a hybrid relay.

FIG. 3 shows a simple circuit for a hybrid drive in accordance with FIG. 1. In this case, a base electrode 11 lies parallel to an armature electrode 23, the two of which are opposite one another in the form of plates and are used as an electrostatic drive when a voltage is applied from the voltage source 40. The electrodes 42 and 43 of a piezo-transducer 41 lie parallel to this electrostatic drive, it being possible for the electrode 43 to be formed from the same layer as the electrode 23. The electrostatic drive having the electrodes 11 and 23, as well as the piezo-drive having the electrodes 42 and 43 can be connected to the voltage source 40 in parallel, via the switch 44. In this case, both drives respond simultaneously and their forces are superimposed in order to close the respective contact.

Figure 4:
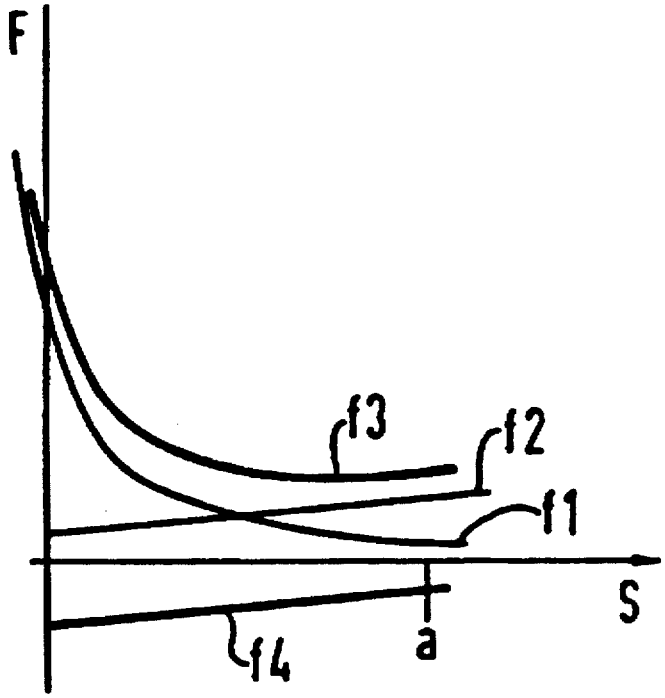
FIG. 4 shows a schematic force diagram for a hybrid relay.

FIG. 4 shows the characteristic of the two drives schematically. The force F is plotted against an axis for the armature separation distance s. In the quiescent state, when the armature separation distance has the value a, the electrostatic force, which is designated by f1, is relatively small; it rises as the armature increasingly approaches the base electrode and reaches a high value when the separation distance s tends to 0. The piezoelectric attraction force, designated by f2, is at its greatest at the start of the armature movement, that is to say when the armature separation distance is large. It becomes smaller as the deflection of the bending transducer toward the base electrode increases. The piezoelectric force f2 thus compensates for the low value of f1 when the armature separation distance a is large, while the electrostatic force f1 compensates for the low value of the piezoelectric force f2 after the armature has closed. This results in an overall response of the forces f3 which can overcome the opposing spring force f4 of the elastic mounting strips over the entire movement path and can produce a large contact force when the armature is closed.

It should be understood that various changes and modifications to the presently preferred embodiments will be apparent to those skilled in the art. Such changes and modifications may be made without changing the spirit and scope of the present invention and without diminishing its attendant advantages. Therefore, such changes and modifications are intended to be covered by the appended claims.

What is claimed is:

1. A micromechanical relay comprising:

a base substrate which is fitted with a flat base electrode and at least one stationary mating contact piece;

an armature substrate arranged on the base substrate, the armature substrate being composed of a selectively etchable material and from which at least one armature is etched free in the form of a tongue which is attached on one side, the armature being fitted with an armature electrode disposed opposite the base electrode, as well as an armature contact piece disposed opposite the mating contact piece, the armature having an elastically flexible region between its attachment to the armature substrate and the armature contact piece, in such a manner that the armature is attracted toward the base substrate when an electrical voltage is applied between the armature electrode and the base electrode;

a piezo-layer disposed on the armature at said flexible region; and a plurality of electrical supply leads, the leads being respectively connected to the base substrate, the armature substrate, the electrodes, the contact pieces, and the piezo-layer;

wherein the piezo-layer which acts as a bending transducer providing a bending force, on excitation, which assists an electrostatic attraction force between the base electrode and the armature electrode.

2. The relay as claimed in claim 1, wherein the base electrode is arranged on an obliquely etched section of the base substrate such that the armature electrode forms a wedge-shaped air gap with the base electrode in the quiescent state, and wherein the armature electrode rests on the base electrode, approximately parallel thereto, in the energized state.

3. The relay as claimed in claim 1 wherein the armature is formed from a surface layer, which is exposed on three sides and is undercut by etching, of an armature substrate which is composed of semiconductor material, and wherein the base substrate is connected to the surface of the armature substrate.

4. The relay according to claim 3 wherein the armature substrate is made of silicon.

5. The relay according to claim 3 wherein the base substrate is made of silicon.

6. The relay according to claim 3 wherein the base substrate is made of borosilicate glass.

7. A relay comprising:

a base substrate including:

a flat base electrode fixed relative to the base substrate; and at least one stationary mating contact piece fixed relative to the base substrate;

an armature substrate disposed against the base substrate, the armature substrate being made of a selectively etchable material, the armature substrate including:

at least one armature etched from the armature substrate and integral therewith, each armature being generally tongue-like and attached on one side to a remainder of the armature substrate;

an armature electrode secured to each armature opposite the base electrode;

an armature contact piece secured near an end of each armature and disposed opposite the mating contact piece; and an elastically flexible region such that the armature is movable;

wherein an electrostatic force is selectively actuatable between the base electrode and the armature electrode when a voltage is applied therebetween, the electrostatic force attracting the armature toward the base substrate; and a piezo-layer operably secured to the flexible region, the piezo-layer being excitable to provide a bending force at the flexible region which assists the electrostatic force.

* * * * *